US010710798B1

(12) United States Patent
Westrum et al.

(10) Patent No.: US 10,710,798 B1
(45) Date of Patent: Jul. 14, 2020

(54) LINER BAG FOR WASTE AND RECYCLING CONTAINERS

(71) Applicant: Vanstrum, LLC, McFarland, WI (US)

(72) Inventors: Derek C Westrum, McFarland, WI (US); Brock A. Vander Velden, McFarland, WI (US)

(73) Assignee: VANSTRUM, LLC, McFarland, WI (US)

( * ) Notice: Subject to any disclaimer, the term of this patent is extended or adjusted under 35 U.S.C. 154(b) by 654 days.

(21) Appl. No.: 14/272,084

(22) Filed: May 7, 2014

Related U.S. Application Data

(60) Provisional application No. 61/820,983, filed on May 8, 2013.

(51) Int. Cl.

| | |
|---|---|
| ***B65D 33/28*** | (2006.01) |
| ***B65F 1/06*** | (2006.01) |
| ***B65F 1/00*** | (2006.01) |
| ***B65F 1/16*** | (2006.01) |

(52) U.S. Cl.
CPC ..... *B65F 1/06* (2013.01); *B65F 1/0006* (2013.01); *B65F 1/0026* (2013.01); *B65F 1/1607* (2013.01); *B65D 33/28* (2013.01)

(58) Field of Classification Search
CPC ..... B65F 1/06; B65F 1/0006; B65F 1/1607; B65F 1/0026; B65F 2210/102; B65F 2210/1125; B65F 10/04; B65D 33/28; B65D 81/264; B65D 81/28; B65D 25/14; B65D 25/16; B65D 88/1606; Y10T 29/53
USPC ..... 220/495.07, 495.08, 62.21, 495.01, 220/495.06, 495.11; 206/205; 383/122, 383/121.1, 75, 76, 33
See application file for complete search history.

(56) References Cited

U.S. PATENT DOCUMENTS

| | | | | | |
|---|---|---|---|---|---|
| 2,010,380 | A | * | 8/1935 | Schaaf | B65D 29/00 383/121 |
| 2,104,686 | A | | 3/1936 | Wood | |
| 3,148,799 | A | * | 9/1964 | Meroney | B65F 1/0006 206/524.5 |
| 3,179,323 | A | * | 4/1965 | Miller | B65D 1/0292 220/23.87 |
| 3,383,026 | A | * | 5/1968 | McGee | B65D 25/14 229/117.27 |
| 3,849,373 | A | * | 11/1974 | Siegle et al. | 525/328.2 |
| 4,892,223 | A | | 1/1990 | DeMent | |
| 5,372,429 | A | * | 12/1994 | Beaver, Jr. | B65D 33/2508 206/524.3 |
| 5,547,104 | A | * | 8/1996 | Parker | B65F 1/12 220/769 |
| 6,029,844 | A | * | 2/2000 | Brady | B65F 1/0006 220/495.08 |

(Continued)

OTHER PUBLICATIONS

Reusable Kitchen Trash Can Liner/Washable Recycling Can Liner: http://www.etsy.com/listing/93902500/reusable-kitchen-trash-can-liner.

*Primary Examiner* — Anthony D Stashick
*Assistant Examiner* — James M Van Buskirk
(74) *Attorney, Agent, or Firm* — Charles S. Sara; Elizabeth L. Neal; DeWitt LLP

(57) ABSTRACT

A reusable and disposable liner for large waste and recycling containers includes a waterproof or resistant material made of at least two pieces of the material comprising the body and the base. The base is constructed such that there is no seam below an upper edge of the base to allow for leakage of a liquid material.

12 Claims, 4 Drawing Sheets

(56) References Cited

U.S. PATENT DOCUMENTS

| | | | | |
|---|---|---|---|---|
| 6,296,138 | B1 * | 10/2001 | Hannah et al. | 220/495.08 |
| 6,471,221 | B1 * | 10/2002 | McGarry | B65F 1/068 220/772 |
| 6,935,782 | B2 * | 8/2005 | Cholsaipant | B65D 90/24 383/24 |
| 7,273,155 | B1 * | 9/2007 | Gray | B65F 1/06 220/495.04 |
| 7,914,207 | B1 * | 3/2011 | Beam | B65D 33/28 220/495.11 |
| 8,550,252 | B2 | 10/2013 | Borowski et al. | |
| 2008/0135557 | A1 * | 6/2008 | Williams | 220/288 |
| 2008/0179330 | A1 | 7/2008 | Brooks et al. | |
| 2013/0168396 | A1 * | 7/2013 | Quan | B65F 1/1607 220/495.11 |
| 2013/0186900 | A1 | 7/2013 | Heintzman | |

* cited by examiner

LINER BAG FOR WASTE AND RECYCLING CONTAINERS

CROSS-REFERENCE TO RELATED APPLICATION

The application claims priority to U.S. Provisional Application entitled "REUSABLE AND DISPOSABLE LINER FOR LARGE WASTE AND RECYCLING CONTAINERS," Ser. No. 61/820,983, filed May 8, 2013, which is incorporated herein by reference in its entirety.

FIELD OF THE INVENTION

The present invention is directed to a reusable liner bag for a large can or container and specifically directed to a reusable and disposable impervious liner for a trash can container.

DESCRIPTION OF THE PRIOR ART

The present invention is specifically directed to large trash and recycle containers which are in use in most municipalities today. The purpose of the containers is to receive trash, recycled material and compost from households and other establishments. Because of the large size of the trash containers, a user is not likely to place a liner in the container to receive trash. Typically, trash is dumped in the container often without first placing it in a sealed bag. Thus, all manner of trash will mix and spill out into the container. The situation is compounded when liquid trash is present as the liquid trash typically leaks to the floor of the container. This type of liquid trash often dries to the floor of the container leaving an unsanitary, malodorous mass on the floor, which is not only difficult to remove but may result in insect infestation and/or unwanted microbial growth.

The containers are usually emptied once a week. Typically, the containers are placed at the side of the road. A trash truck will drive alongside the container and lift each container using a movable arm to upend the container thereby removing the contents into the bed of the trash truck.

After a time, the container will tend to build up bad smells, insects, bacteria and residue from the loose trash, all of which needs to be removed. The smells emanating from the containers can become intolerable. Because of the size of the garbage bins and containers, they are often difficult to clean and for that reason many households do not clean them which can lead to sanitation issues. Thus, there is a need to contain the garbage placed in large containers in such a manner that the garbage does not produce a lasting unsightly, dangerous and malodorous effect on the container.

It is therefore an object of the present invention to create a system which contains the trash, but does not dirty the container itself.

SUMMARY OF THE INVENTION

The present invention is directed to a reusable and disposable liner for large waste and recycling containers that are used by waste management companies or the like which have weekly garbage service for their customers. Specifically, the present invention is directed to a reusable flexible liner for a trash container, comprising a body having an open top edge, a bottom edge, opposing sides and an interior; a closure device at the top end for securing the liner to the container; and a one-piece base connected to the bottom edge of the body forming a seamless floor.

The present invention is further directed to a trash containment and removal system comprising a trash container and a flexible liner for the trash container, wherein the liner comprises a body having an open top edge, a bottom edge, opposing sides and an interior; a closure device at the top end for securing the liner to the container; and a one-piece base connected to the bottom edge of the body forming a seamless floor.

The liner can be reused as often as practical until it is determined that the liner must be replaced.

Because the liner is waterproof, liquid garbage and other contaminants will not touch and therefore dirty the container, leaving the container clean of garbage spillage.

Using the liner in the large bins allows consumers to dump "loose" trash into the bin from household waste containers that are typically lined with plastic disposable bags reducing the consumption of plastic waste containers which can be a cost savings to consumers and can reduce the amount of plastic trash bags in landfills.

Consumers can dispose of the reusable liner at the onset of any waste build-up therefore eliminating much of the smells and stench that the garbage build-up creates.

The re-usable liners themselves are made of recyclable material.

The objects and advantages of the invention will appear more fully from the following detailed description of the preferred embodiment of the invention made in conjunction with the accompanying drawings.

DETAILED DESCRIPTION OF THE INVENTION

Figure 1:
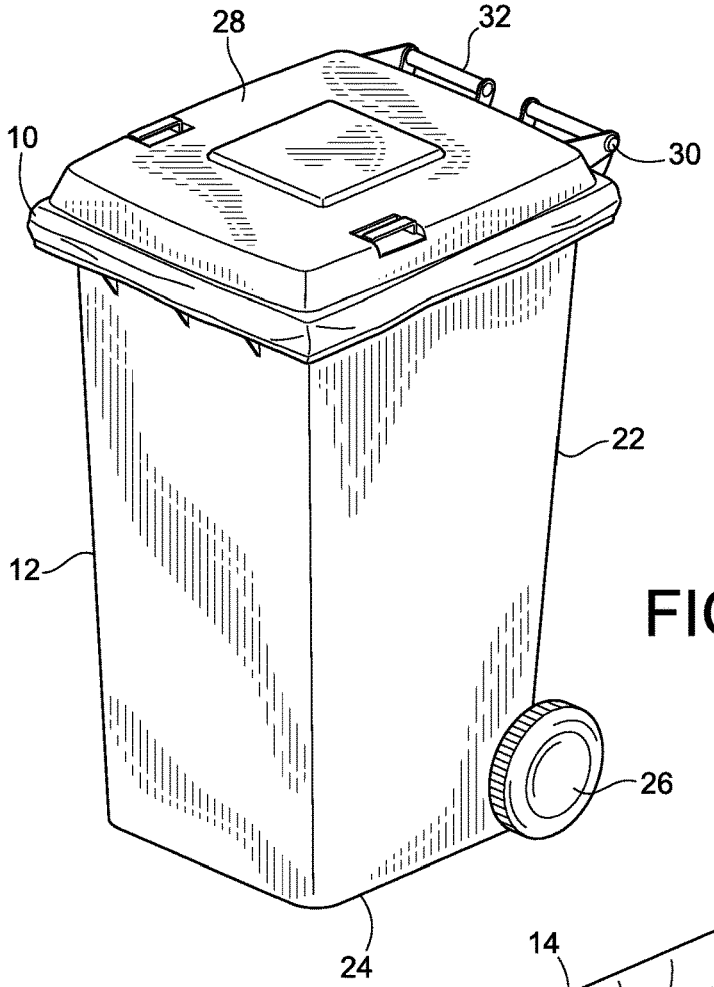
FIG. 1 is a perspective view of a trash container with a closed lid and illustrating the placement of the liner bag of the present invention.
Figure 2:
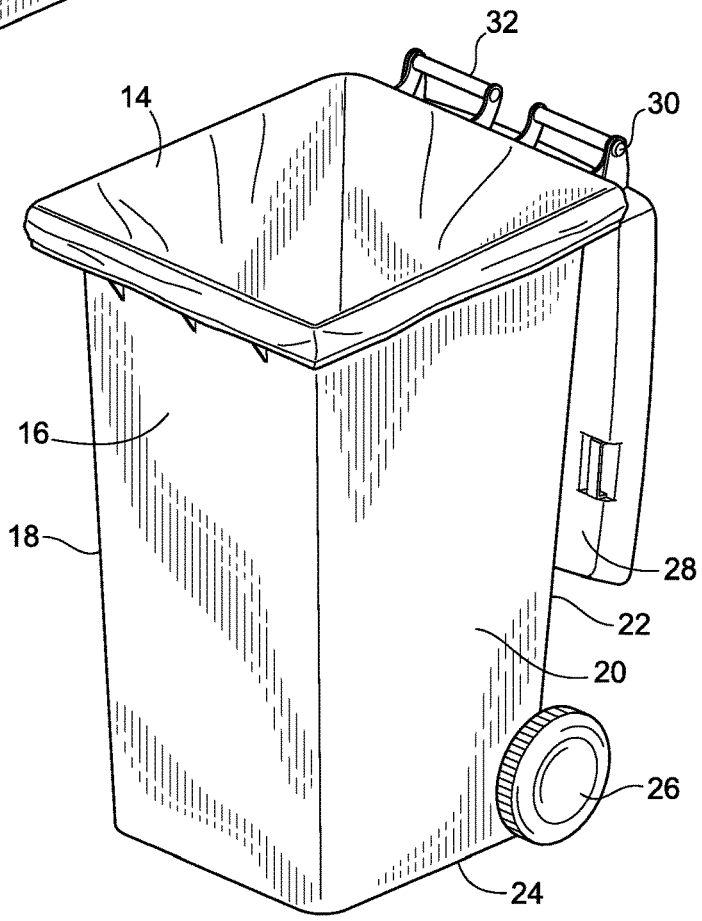
FIG. 2 is a perspective view of a trash container with an open lid and illustrating the placement of the liner bag of the present invention.

Container 12:

Referring to FIGS. 1 and 2, there is illustrated a liner 10 which is used for placement in trash or recycle containers 12. The illustrated container 12 is directed to a standard wheeled container, described the prior section above, including an open top area 14, front 16, opposing sides 18, 20, rear 22, base 24 and a set of wheels 26 for easily transporting the container. In addition the container 12 includes a lid 28 which may be rotatably attached to the top 14 of the container 12 by a set of hinges 30. Located near the hinges 30 is a handle 32 to assist with the transportation of the container 12 from one place to another. Such a container 12 is typically used in household and industrial settings for removing garbage. The illustrated container 12 is typically a large size, e.g., 45 gallons or more, wheeled trash can with a hinged lid. While this container 12 is illustrated for purposes of describing the present invention, it is within the scope of the present invention to use a wide variety of containers, including round, wheel-less containers and containers in which the lid is not hingedly attached or, in some cases, may be missing completely. The size of the container can also vary from that of a small household trash can to a jumbo trash can such as a commercial trash remover system.

Figure 3:
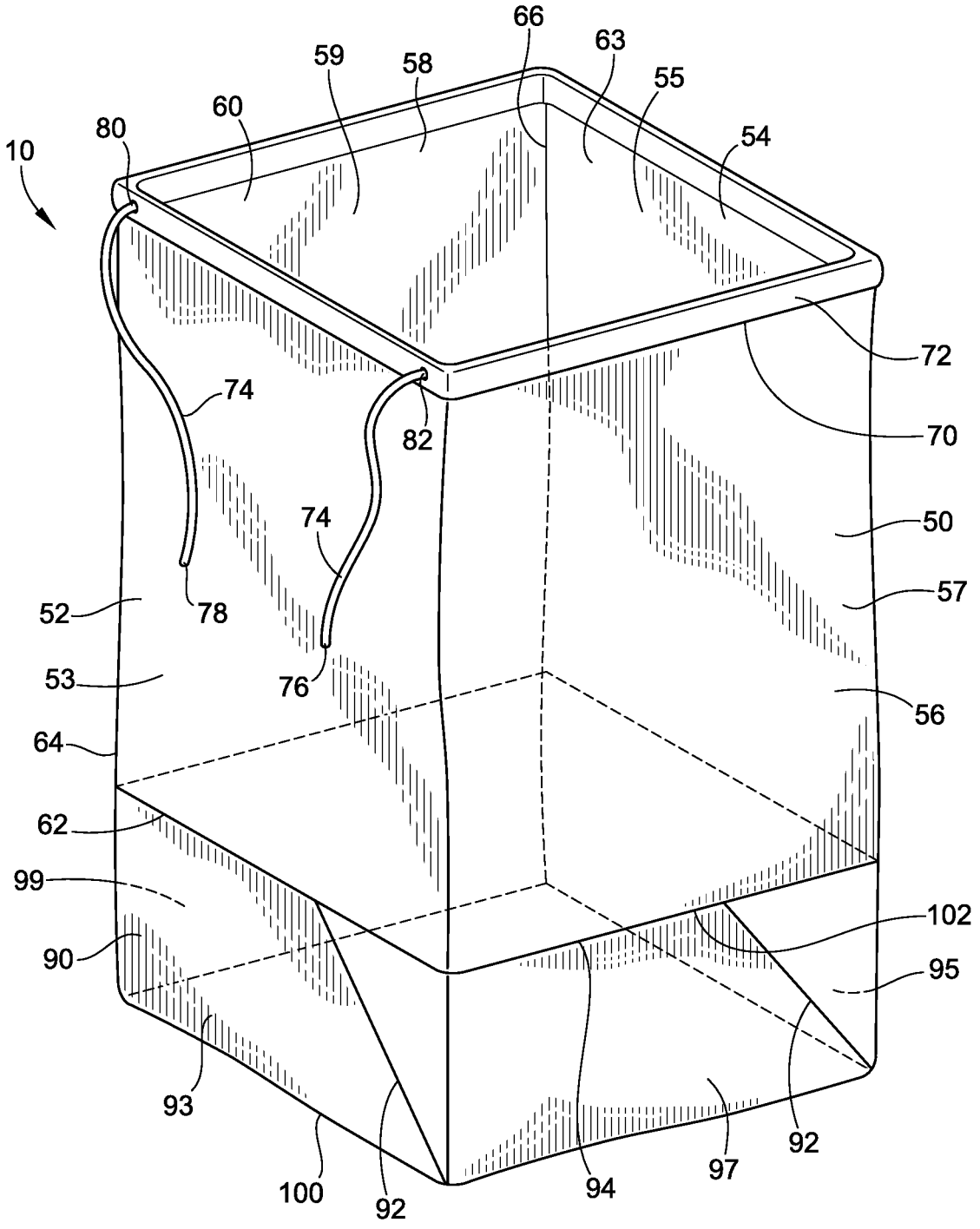
FIG. 3 is a perspective view of the liner bag of the present invention.

Liner 10:

Referring now to FIG. 3, the liner 10 is preferably designed to be water proof or water resistant and reusable for a certain period of time. Accordingly, the liner 10 is typically made from any water-proof or water resistant, flexible material or any treated material to make it hold household waste liquids inside the liner 10. Preferably, the material is a polypropylene coated woven or non-woven material. All materials are preferably disposable. While polypropylene is the preferred material, other materials, such as polyethylene, nylon, canvas, cotton or a paper product with a liquid resistant coating may be used. A preferred liner 10 is typically a coated ultraviolet treated nonwoven polypropylene bag, which may or may not be breathable. While a non-breathable liner is preferred, it is within the scope of the present invention to use a liner 10 which is breathable or gas permeable.

The liner 10 can either be a single use or reusable liner depending on the type of garbage contained and the needs of the user. The term "single use" is meant to refer to a liner bag which is typically discarded along with its contents. Advantageously in this case, the material of the liner is strong enough for multiple uses. Thus, the liner 10 can be used multiple times until the user feels that the liner has been sufficiently contaminated by the garbage. At that point, the liner 10 can be discarded along with the garbage.

Each liner 10 is preferably custom fit to any container available to the consumer. Additionally, the flexibility of the material making up the liner enables the liner to have certain flexibility in size of the container 12. Thus, a liner 10 developed to fit a 64 gallon container 12 can be folded to fit a smaller, e.g., 33 gallon container.

As illustrated in FIG. 3, the liner 10 has a container or bag-like body constructed from at least two and possibly three pieces of material as described above. The body 50 of the liner 10 is constructed to an appropriate size to match the container 12. The body 50 includes four upper panels. Upper panel 53 is related to side 52. Upper panel 55 is related to side 54. Upper panel 57 is related to side 56. Upper panel 59 is related to side 58. The body 50 includes an open, top end 60, a bottom edge 62 and an interior 63.

The body 50 can be constructed of one piece of material closed at a seam 64. The material is seamed together using ultrasonic welding, sewing, bonding, or other means known to the art. If desired, the body 50 can be made of two pieces of similar material with a seam 64 and an opposing seam 66.

The top edge 60 of the body 50 is overlapped and seamed at 70 to form a channel 72 to enclose a drawstring 74 having two ends 76 and 78, which exit side 52 through eyelet openings 80 and 82. Thus, the drawstring 74 circumvents the top edge 60 of the body 50 via the channel 72. The purpose of the drawstring 74 will be made apparent with respect to other drawings.

The second and lower base piece 90 of the liner 10 is formed of a single rectangular piece of material as described above. The base 90 is folded to form fold lines 92 on each side of the base piece 90, thereby forming lower panels 93, 95, 97 and 99. As shown in FIG. 3, lower panel 93 joins upper panel 53 at seam 94 to form side 52. Likewise, lower panel 95 joins upper panel 55 to form side 54. Sides 56 and 58 are similarly formed with joining lower panels 97 and 99 with upper panels 57 and 59. The lower panels 93, 95, 97 and 99 extend up the vertical side of the liner 10 from the floor 100 preferably about 6 inches to 18 inches and beyond if desired such that the upper edge 102 of the base piece 90 is attached the lower edge 62 of the body 50 at a seam 94 which circumvents all sides of the liner 10.

In this manner, the entire floor 100 and lower panels 93, 95, 97 and 99 of the liner 10 are seamless below the upper edge 102 of the base piece 90, which importantly assists in restricting the possibility of liquid waste exuding from the floor 100 of the liner 10 through a seam. Therefore, any liquid substance in the liner 10 will likely be retained within the interior 63 of the liner 10. In order to further limit any unwanted leakage from the liner 10, the interior 63 of the body 50 may be coated with a water proofing coating. The material may be laminated with a polypropylene membrane. Silicone is another waterproofing membrane that could be used.

Figure 4:
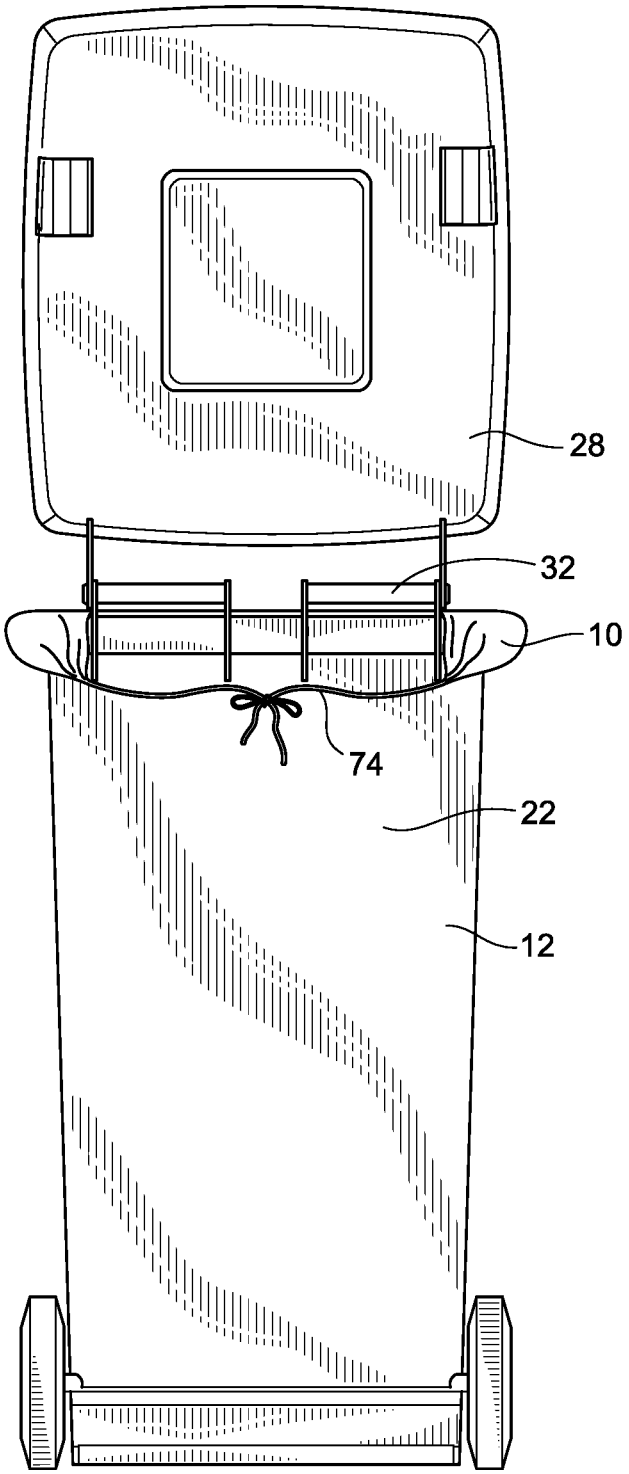
FIG. 4 is a rear plan view of the trash container illustrating the placement of the liner bag therein.
Figure 5:
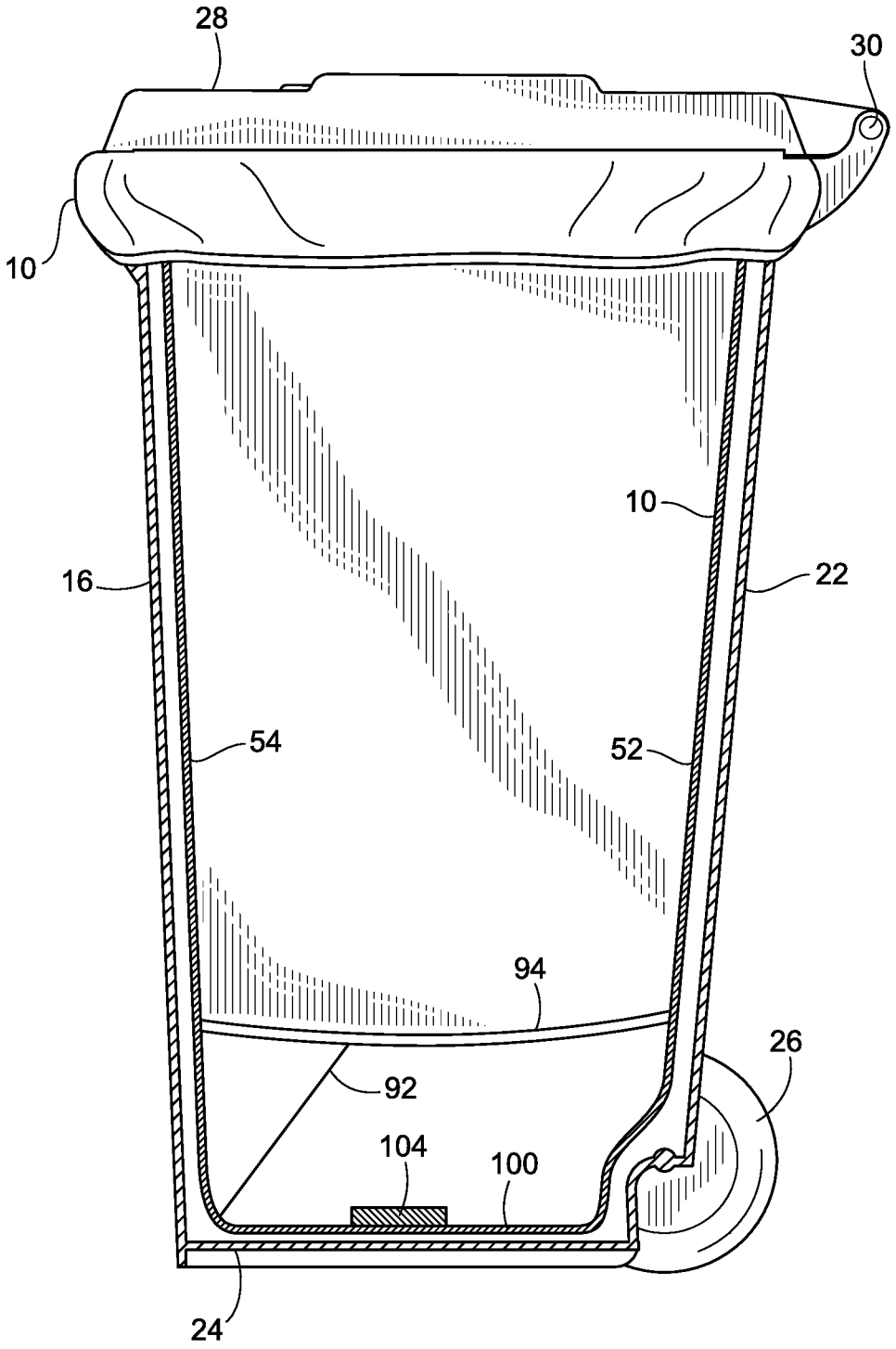
FIG. 5 is a cross-sectional side view of the trash container illustrating the placement of the liner bag therein.

The drawstring 74 runs through the channel 72 at the top 60 of the liner 10. The drawstring 74 exits the channel 72 located at side 52 which is designed to align with the rear 22 of the container 12. As illustrated in FIG. 4, the drawstring 74 secures the liner 10 to the container 12 by tightening and tying the ends 76, 78 of the drawstring together at the rear 22 of the container 12 and preferably under the handle 32. Thus, the drawstring 72 achieves the purpose of securing the liner 10 to the container 12. In addition, and because the drawstring 74 is connected below the container lid handle 32 as illustrated in FIG. 4, the tied drawstring 74 acts to keep the liner 10 attached to the container 12.

Dimensions:

The dimensions of the liner 10 can be customized based on the size of the container 12. Typical sizes for containers 12 include a 35 gallon, 65 gallon and 95 gallon container 12. While the dimensions can be customized to fit each container 12, it is also feasible that a liner 10 suitable for a 95 gallon container 12 will also be used on a 65 or even a 35 gallon container 12.

Absorbent Material:

If desired, the liner 10 can include a secondary absorbent container 104 which has the capacity of entraining odors to reduce the pungent smell of the garbage. The absorbent container 104 may be attached to the base end 62 of the liner 10, or to any of the sides 52, 54, 56, 58 of the liner 10. The odor inhibiting materials can include activated carbon, baking powder and the like. The absorbent container can be in the form of a wafer of absorbent material which is adhered to the interior side or floor of the liner bag. Reference is made to US Patent Publication 2008/0179330 to Brooks et al, which is incorporated herein by reference for the disclosure and description of various forms of absorbent materials.

Operation:

In operation, the liner 10 is installed into a preferably clean container 12 with a coated side facing in. The drawstring channel 74 is folded over the top edge 14 of the container 12 pulled tight and tied at the rear 22 of the container 12 under the hinge 30 and handle 32 mechanism, as illustrated in FIG. 4. An airtight seal is thus formed between the liner 10 and the container 12 creating a vacuum which assists in keeping the liner 10 in place during the dumping process. While a drawstring 74 is the preferred method for attaching the liner 10 to the container 12, the liner 10 can also be fastened to the container 12 in a number of ways, such as clips to hold the liner 10 to the container 12, hook and loop or VELCRO attachments or other means known to the art. In this manner, the liner 10 will remain in the container 12 even if the container 12 is upended during the dumping process.

The liner 10 is preferably made of a coated polypropylene which is a durable product and can stay intact in the container 12 until the user decides to dispose or replace it. When the user decides to dispose the liner 10, the user unties the drawstring 74 and the liner 10 will be released from the container 12 with its contents during the next dumping process.

The liner 10 can also be removed, washed and rinsed to clean debris and smells that accumulate from use.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within the range, whether specifically disclosed or not. Further, these numerical ranges should be construed as providing support for a claim directed to any number of subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated reference, the patent disclosure controls.

The devices, methods, compounds and composition of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. A trash containment and removal system comprising a trash container and a flexible liner for the trash container, wherein the liner comprises:

a. a body having an open top edge, a bottom edge, opposing sides and an interior;

b. a closure device at the top edge for securing the liner to the container; and c. a one-piece base having folded panels connected at an upper edge of the panels to the bottom edge of the body, the one-piece base being seamless below the upper edge of the folded panels and forming a seamless floor, wherein the liner forms an airtight seal with the trash container, creating a vacuum which keeps the liner in place within the trash container during a dumping process.

2. The system of claim 1 wherein the trash container comprises an open top area, a front, opposing sides, a rear, a base and a set of wheels for transporting the container.

3. The system of claim 2 wherein the trash container comprises a lid.

4. The system of claim 3 wherein the lid is rotatably attached to the top area of the container.

5. The system of claim 1 wherein the liner is reusable and water resistant.

6. The system of claim 1 wherein the liner is waterproof.

7. The system of claim 1 wherein the liner is selected from materials consisting of polypropylene coated woven or non-woven material, polyethylene, nylon, canvas or cotton.

8. The system of claim 1 wherein the liner is disposable.

9. The system of claim 1 wherein the liner is a coated ultra violet treated circular woven polypropylene bag.

10. The system of claim 1 wherein the closure device includes a channel formed on the open top end of the body, the channel including a drawstring for securing the liner to the container.

11. The system of claim 1 comprising an odor absorbent material.

12. The system of claim 11 wherein the odor absorbent material is attached to the interior of the liner.

* * * * *